US007159909B1

(12) United States Patent
Hung

(10) Patent No.: US 7,159,909 B1
(45) Date of Patent: Jan. 9, 2007

(54) CABINET ENCLOSURE HANDLE

(76) Inventor: Kuo-Chuan Hung, No. 19, Lane 222, Chung Shan 2nd Rd., Lu-Chou City, Taipei Hsien (TW)

( * ) Notice: Subject to any disclaimer, the term of this patent is extended or adjusted under 35 U.S.C. 154(b) by 0 days.

(21) Appl. No.: 11/266,282

(22) Filed: Nov. 4, 2005

(51) Int. Cl.
*E05B 3/00* (2006.01)

(52) U.S. Cl. ..... 292/336.3; 292/DIG. 31; 70/208

(58) Field of Classification Search ..... 292/336.3, 292/347, DIG. 31; 70/207–209
See application file for complete search history.

(56) References Cited

U.S. PATENT DOCUMENTS 2,278,534 A * 4/1942 Dickason ..... 292/336.3
5,469,725 A * 11/1995 Yamada ..... 70/208
5,722,269 A * 3/1998 Simon et al. ..... 70/208

* cited by examiner

*Primary Examiner*—Gary Estremsky
(74) *Attorney, Agent, or Firm*—Troxell Law Office, PLLC

(57) ABSTRACT

A cabinet enclosure handle is primarily composed of a handle seat, a handle, a spindle kit, and a lock, wherein the spindle kit includes a Y-shape fixing pin, an elastic member, two gaskets, and a hook piece. The elastic member and Y-shape fixing pin are pivoted to pivot holes of a pivoting end of handle orderly, and the lock is installed in a fixing slot of a locking end of handle. Next, a fixing end of Y-shape fixing pin, followed by the gaskets and hook piece, are passed through a rotating hole on the handle seat and fixed together. The handle can be automatically ejected from the handle seat, after opening the lock, which is easy to hold the handle for rotating. The handle structure provided with the advantages that a cost can be reduced due to its simple structure, and it is fast to assemble and easy to hold.

1 Claim, 5 Drawing Sheets

CABINET ENCLOSURE HANDLE

BACKGROUND OF THE INVENTION (a) Field of the Invention

The present invention relates to a cabinet enclosure handle, and more particularly to a handle structure installed on a front door of cabinet of a industry computer, wherein the handle can be automatically ejected from a handle seat to be easily held and rotated. The handle structure is provided with the advantages that a cost can be reduced due to its simple structure, and it is fast to assemble and easy to hold.

(b) Description of the Prior Art

It is known that an ordinary industry computer is installed in a casing of large cabinet, and in order to avoid a touch in mistake by an non working member or during an operation, a handle structure with a lock is installed on a front surface of the cabinet casing. Referring to FIG. 1 and FIG. 2, the handle structure a is primarily composed of a handle seat a1, a handle a2, a latch structure a3, and a lock a4, wherein the handle seat a1 is located at a proper position of a door leaf of the cabinet, and a pivot end a21 of the handle a2 is inserted into a hemispheric slot a11 of the handle seat a1 followed by fixing with a rotating gear a31 of the latch structure a3. The rotating gear a31 is against on a sliding plate a12 at one side of the handle seat a1. A plurality of sawtooth structures a121 whose shape and interval fit with the rotating gear a31 is located on the sliding plate a12, an a U-shape chunk a122 which can be latched to a latch part on a frame of the cabinet is located at the other side of the sliding plate a12. On the other hand, the lock a4 is divided into two parts, which are located on the handle a2 and a corresponding position on the handle seat a1, respectively.

According to the aforementioned structures, the handle a2 can be pulled out and rotated only when the lock a4 is opened. By rotating the handle a2, along with the rotating gear a31 of latch structure a3, a limited movement in a vertical direction will be generated to the sliding plate a12, such that the U-shape chunk a122 of the sliding plate a12 can be escaped from the latch part of frame of cabinet, thereby achieving a function of opening the door. In addition, as this device has a beautiful shape and a firm structure, the practicability and purpose of opening the door are accurately achieved by rotating the handle. However, as the device has a complicated structure and a variety of components, and fitness should be taken care of during manufacturing, it is easy to increase a cost and difficulty in manufacturing; therefore an improvement is required.

SUMMARY OF THE INVENTION

The primary object of the present invention is to provide an cabinet handle structure wherein the handle can be automatically ejected from a handle seat to be easily held and rotated. The handle structure is provided with the advantages that a cost can be reduced due to its simple structure, and it is fast to assemble and easy to hold.

Accordingly, the present invention comprises primarily a handle seat, a handle, a spindle kit, and a lock, wherein the spindle kit includes a Y-shape fixing pin, an elastic member, two gaskets, and a hook piece. The Y-shape fixing pin is provided with a ball-shape top end, and an opening, which is in a Y shape if being viewed from a side, in a center for installing the elastic member. After the elastic member is emplaced into the opening of the Y-shape fixing pin, they are pivoted to pivot holes of a pivot end of the handle. The lock is installed in a fixing slot of locking end of the handle, and a bottom of Y-shape fixing pin, followed by the gaskets and hook piece, are passed through a rotating hole on the handle seat and fixed together.

In assembling the aforementioned structures, the handle seat of handle structure is first installed in a handle hole on an edge of a door leaf of the cabinet, such that the hook piece of handle structure is protruded from a rear surface of the door leaf, and is then directly latched to a vertical frame of the cabinet with a latch part on the hook piece, to achieve a purpose of fixing. The assembling is very fast and convenient. On the other hand, the handle will be automatically ejected after opening the lock. Therefore, the handle only needs to be rotated in usage, and the hook piece will be escaped from the vertical frame, thereby achieving the purposes of opening the door leaf of cabinet and easiness in usage. The present invention is provided with the advantages that a cost of manufacturing can be reduced due to its simple structure, and it is easier and more convenient to use due to a reduced friction at a contact place between the top end of Y-shape fixing pin and plastic components, resulting from the ball-shape design.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
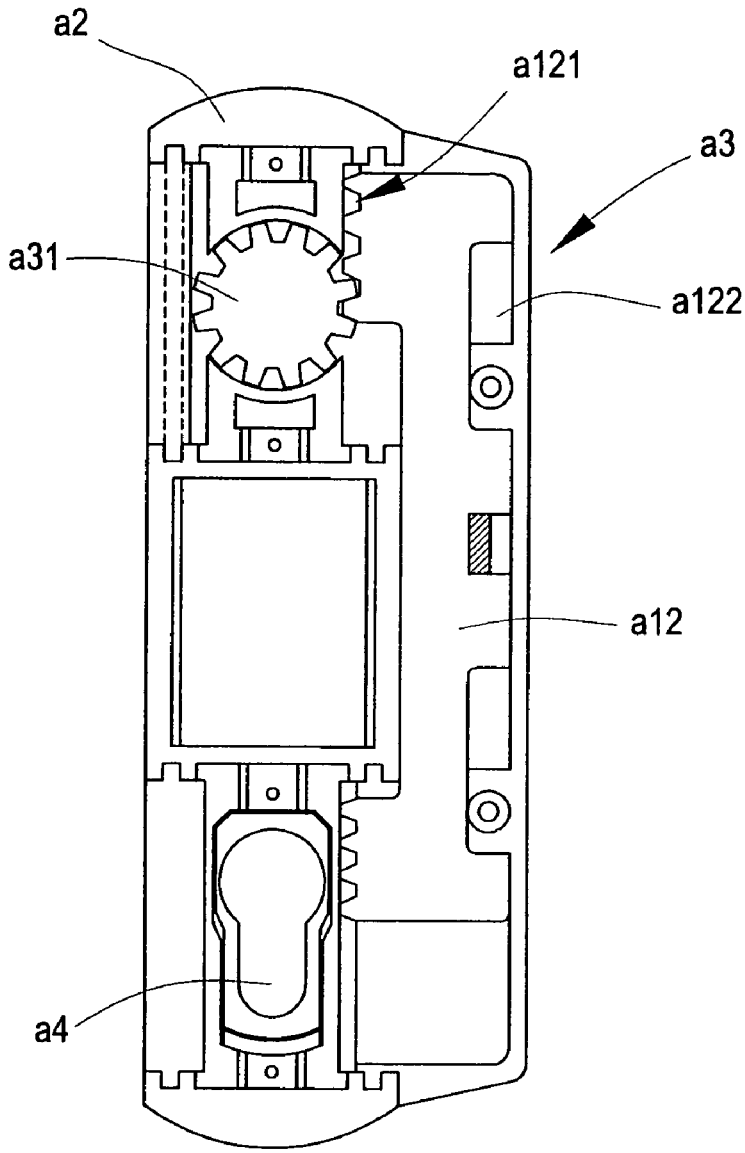
Fig.1(PRIOR ART)
FIG. 1 shows a rear view of a conventional handle structure.
Figure 2:
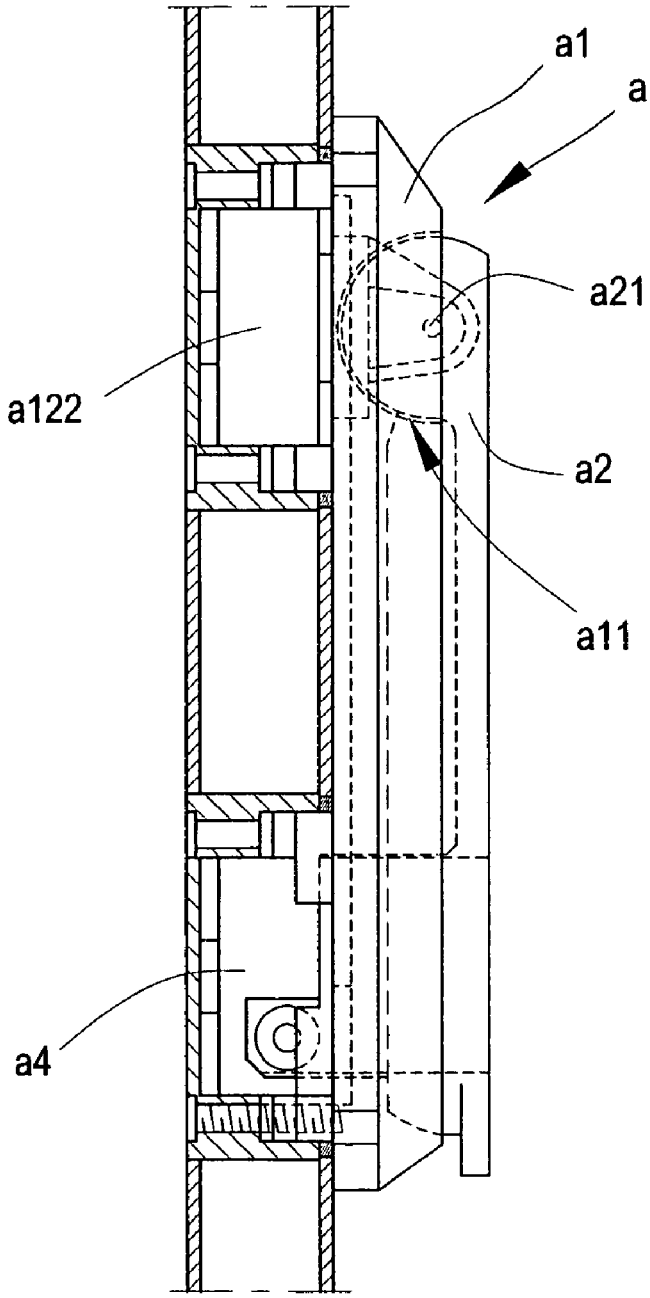
Fig.2(PRIOR ART)
FIG. 2 shows a side view of a conventional handle structure.
Figure 3:
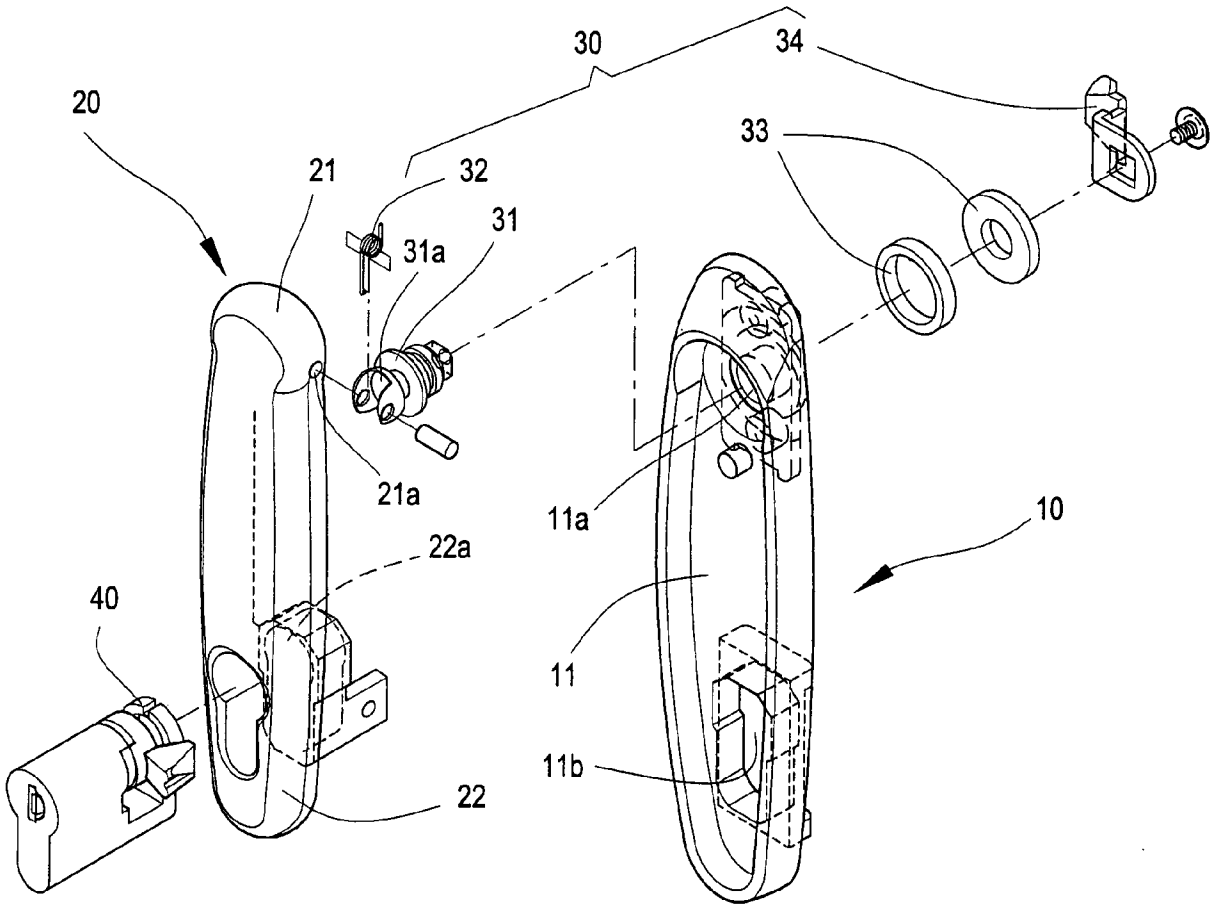
FIG. 3 shows a perspective view of the present invention before assembling.
Figure 4:
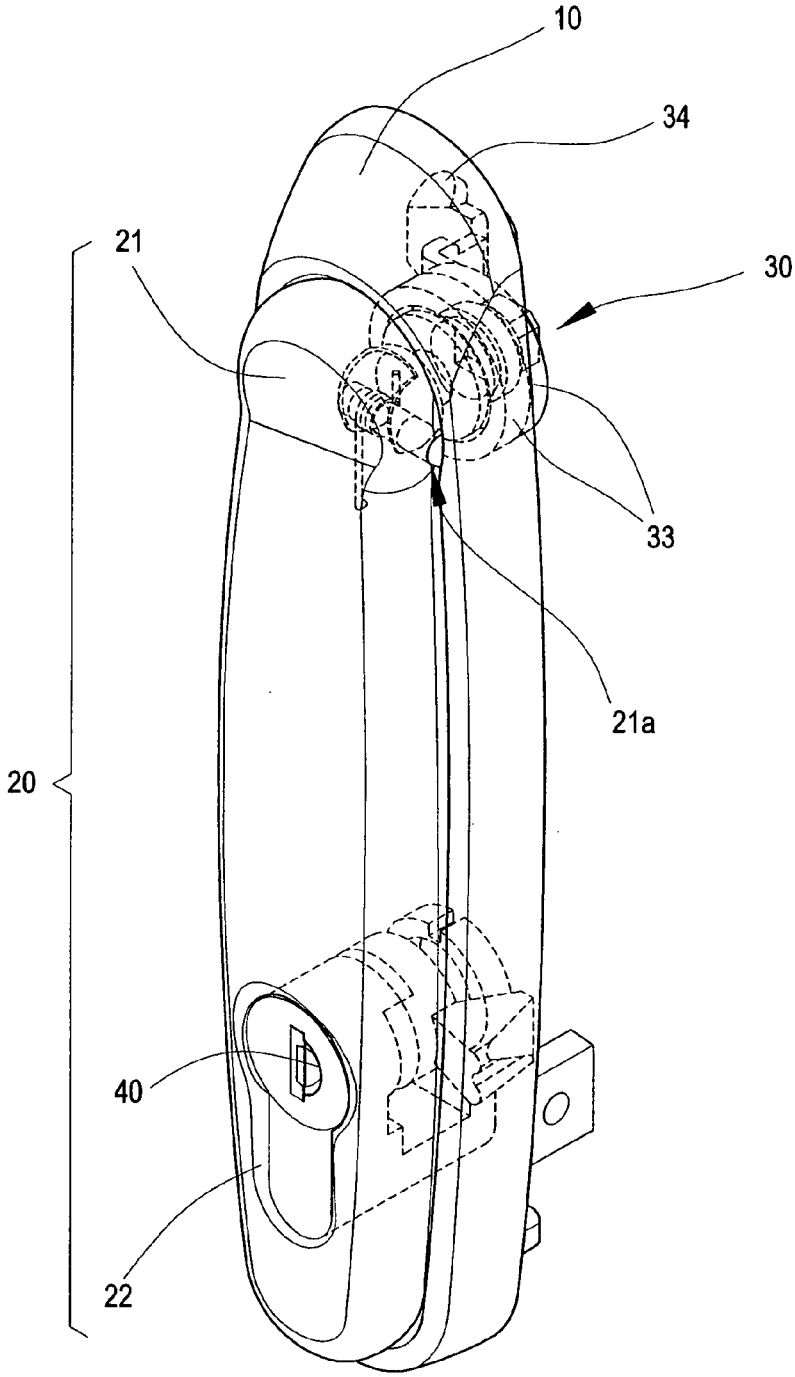
FIG. 4 shows a perspective view of the present invention after assembling.

Referring to FIG. 3 and FIG. 4, a handle structure 1 of the present invention comprises primarily a handle seat 10, a handle 20, a spindle kit 30, and a lock 40, wherein the handle seat 10, which is made into a long oval shape, is provided with a holding slot 11 at a center part thereof, with a rotating hole 11*a* and a lock hole 11*b* located at a bottom of the holding slot 11.

The handle 20, which is made into a same shape and size as those of the holding slot 11 of the handle seat 10, is provided with a long slot at a rear side; whereas, two pivot holes 21*a* are located at two sides of a pivoting end 21 on a top of the long slot, and a fixing slot 22*a* is located at a locking end 22 on a bottom of the long slot.

The spindle kit 30 includes a Y-shape fixing pin 31, an elastic member 32, two gaskets 33, and a hook piece 34, wherein the Y-shape fixing pin 31 is provided with a ball-shape top end whose center part is provided with an opening 31*a*, which is roughly in a Y shape if being viewed from a side, for emplacing the elastic member 32. After the elastic member 32 is emplaced into the opening 31*a* of the Y-shape fixing pin 31, they are pivoted to the pivot holes 21*a* of pivoting end 21 of the handle 20. The lock 40 is installed in the fixing slot 22*a* of locking end 22 of the handle 20, and a bottom of the Y-shape fixing pin 30, followed by the gaskets 33 and hook piece 34, are passed through the rotating hole 11*a* on handle seat 11*a* and fixed together.

Figure 5:
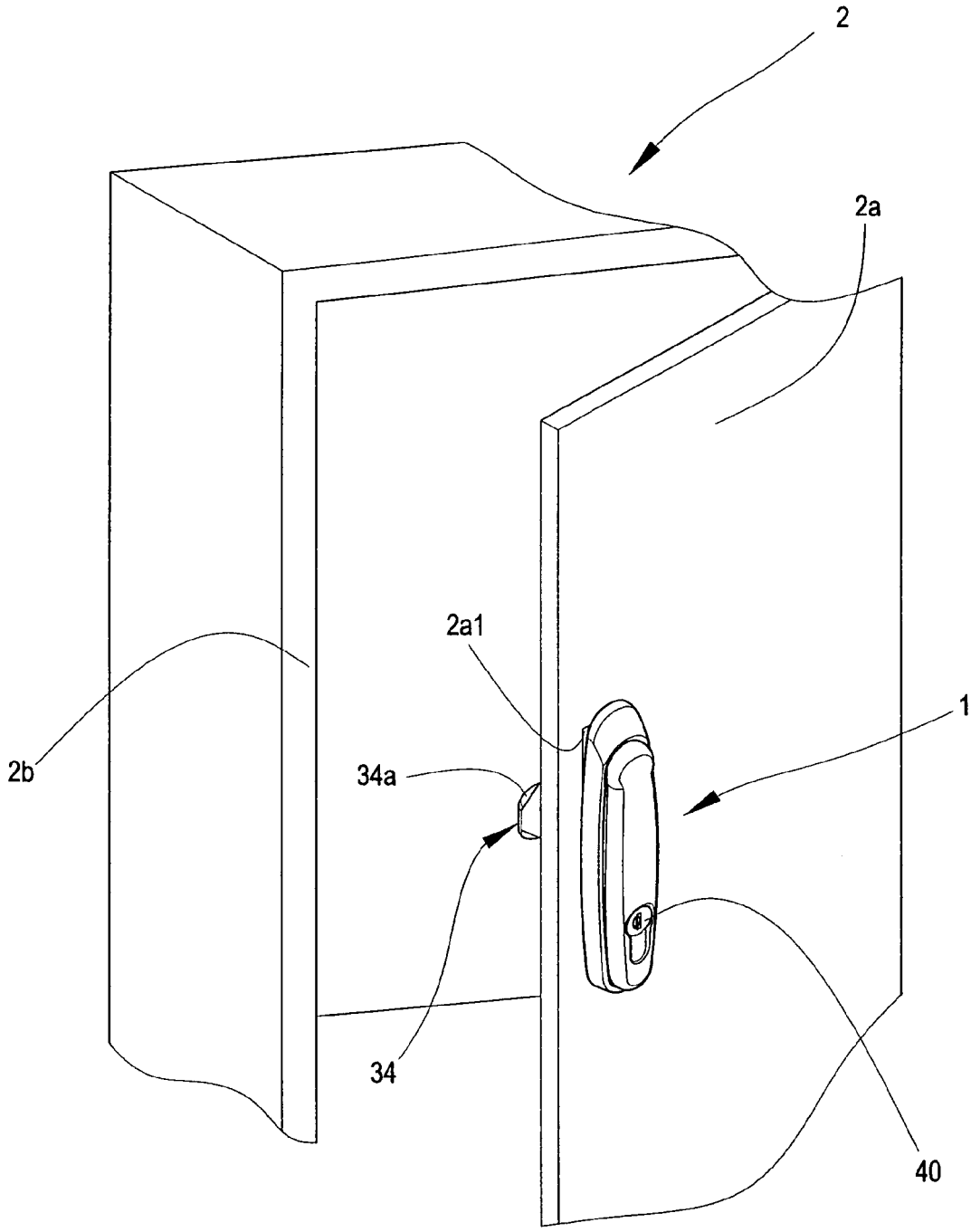
FIG. 5 shows a schematic view of a status of using of the present invention.

Referring to FIG. 5, the handle structure 1 of present invention is installed in a handle hole 2*a*1 on an edge of a door leaf 2*a* of cabinet 2, such that the hook piece 34 of handle structure 1 is protruded from a rear surface of the door leaf 2*a*, and is then directly latched to a vertical frame 2*b* of the cabinet 2 with a latch part 34*a* on the hook piece 34. The handle structure 1 is very convenient to assemble, and the handle 20 can be automatically ejected after opening the lock 40, which will facilitate rotating in usage.

Accordingly, the present invention, with the design of handle, handle seat, and ball-shape spindle kit, is provided with the advantages that a cost can be reduced due to its simple structure, a friction force can be effectively reduced upon rotating, and it is fast and convenient to assemble and is easy to hold and rotate the handle for opening the door leaf.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A cabinet enclosure handle primarily comprising a handle seat, a handle, a spindle kit, and a lock, wherein the handle seat is made into a long oval shape and is provided with a holding slot at a center part, with a rotating hole and a lock hole located at a bottom of the holding slot; the handle being made into a same shape and size as those of the holding slot of handle seat, and being provided with a long slot at a rear surface, with pivot holes at two sides of a pivoting end on a top of the long slot, and a fixing slot at a locking end on a bottom of the long slot; the spindle kit including a Y-shape fixing pin, an elastic member, two gaskets, and a hook piece; the Y-shape fixing pin having a ball-shape top end and an opening, which is roughly in a Y shape if being viewed from a side, at a center part for emplacing the elastic member; the Y-shape fixing pin and elastic member being pivoted to the pivot holes of pivoting end of handle, after emplacing the elastic member into the opening of Y-shape fixing pin; the lock being installed in the fixing slot of locking end of handle; a bottom of the Y-shape fixing pin, followed by the gaskets and hook piece, being passed through the rotating hole on handle seat and fixed together.

* * * * *